US011417271B2

(12) United States Patent
Yu et al.

(10) Patent No.: US 11,417,271 B2
(45) Date of Patent: Aug. 16, 2022

(54) BRIGHTNESS ADJUSTMENT METHOD OF DISPLAY PANEL, DISPLAY PANEL AND DRIVING METHOD THEREOF

(71) Applicants: CHENGDU BOE OPTOELECTRONICS TECHNOLOGY CO., LTD., Sichuan (CN); BOE TECHNOLOGY GROUP CO., LTD., Beijing (CN)

(72) Inventors: Yong Yu, Beijing (CN); Chuanyan Lan, Beijing (CN); Lixia Shen, Beijing (CN); Xiaohuan Chang, Beijing (CN)

(73) Assignees: CHENGU BOE OPTOELECTRONICS TECHNOLOGY CO., LTD., Chengdu (CN); BOE TECHNOLOGY GROUP CO., LTD., Beijing (CN)

( * ) Notice: Subject to any disclaimer, the term of this patent is extended or adjusted under 35 U.S.C. 154(b) by 669 days.

(21) Appl. No.: 16/336,706

(22) PCT Filed: Oct. 15, 2018

(86) PCT No.: PCT/CN2018/110281
§ 371 (c)(1),
(2) Date: Mar. 26, 2019

(87) PCT Pub. No.: WO2019/114400
PCT Pub. Date: Jun. 20, 2019

(65) Prior Publication Data

US 2021/0366384 A1 Nov. 25, 2021

(30) Foreign Application Priority Data

Dec. 15, 2017 (CN) ..... 201711353495.6

(51) Int. Cl.
*G09G 3/3233* (2016.01)
*G09G 3/3266* (2016.01)

(52) U.S. Cl.
CPC ..... *G09G 3/3233* (2013.01); *G09G 3/3266* (2013.01); *G09G 2300/0842* (2013.01);
(Continued)

(58) Field of Classification Search
CPC ..... G09G 3/3233; G09G 3/3266; G09G 2300/0842; G09G 2320/0233; G09G 2320/0626; G09G 2320/0686
See application file for complete search history.

(56) References Cited

U.S. PATENT DOCUMENTS 7,952,542 B2 * 5/2011 Yamashita ..... G09G 3/3233 345/76
9,536,498 B2 1/2017 Wu et al.
(Continued)

FOREIGN PATENT DOCUMENTS

CN 103500566 A 1/2014
CN 103975380 A 8/2014
(Continued)

OTHER PUBLICATIONS

Second Chinese Office Action Application No. 201711353495.6; dated Sep. 22, 2020.
(Continued)

*Primary Examiner* — Christopher E Leiby

(57) ABSTRACT

A brightness adjustment method of a display panel, a display panel and a driving method thereof are disclosed. The display panel includes a display region. The brightness adjustment method includes: determining a target pulse width for a gate signal inputted into the display region according to data write time determined for the display region; and adjusting a pulse width of the gate signal to the
(Continued)

target pulse width, to make the display region display target brightness corresponding to the display region.

19 Claims, 8 Drawing Sheets

(52) U.S. Cl.
CPC ..... *G09G 2320/0233* (2013.01); *G09G 2320/0626* (2013.01); *G09G 2320/0686* (2013.01)

(56) References Cited

U.S. PATENT DOCUMENTS 10,276,099 B2 * 4/2019 Lee ..... G09G 3/3233
10,319,295 B2 6/2019 Yin
2007/0159441 A1 * 7/2007 Yang ..... G09G 3/3677 345/99
2008/0042939 A1 * 2/2008 Yamashita ..... H01L 27/3265 345/76
2008/0231560 A1 * 9/2008 Yamashita ..... G09G 3/3266 345/76
2009/0315813 A1 * 12/2009 Uchino ..... G09G 3/3233 345/76
2012/0313922 A1 * 12/2012 Toyomura ..... G09G 3/3225 345/212
2012/0327058 A1 * 12/2012 Minami ..... G09G 3/3225 345/211
2014/0347405 A1 * 11/2014 Kumeta ..... G09G 5/10 345/690
2016/0117987 A1 4/2016 Byun
2016/0210900 A1 * 7/2016 Kim ..... G09G 3/3233
2017/0018225 A1 1/2017 Omoto et al.

FOREIGN PATENT DOCUMENTS

CN 105609053 A 5/2016
CN 106935187 A 7/2017
CN 107393480 A 11/2017
KR 20170130680 A 11/2017

OTHER PUBLICATIONS

International Search Report and Written Opinion dated Jan. 14, 2019; PCT/CN2018/110281.
The Extended European Search Report dated Jun. 29, 2021; Appln. No. 18857380.2.

* cited by examiner

BRIGHTNESS ADJUSTMENT METHOD OF DISPLAY PANEL, DISPLAY PANEL AND DRIVING METHOD THEREOF

CROSS-REFERENCE TO RELATED APPLICATION

The present application claims priority of the Chinese Patent Application No. 201711353495.6, filed on Dec. 15, 2017, the disclosure of which is incorporated herein by reference in its entirety as part of the present application.

TECHNICAL FIELD

The embodiments of the present disclosure relate to a brightness adjustment method of a display panel, a display panel and a driving method thereof.

BACKGROUND

Electroluminescent elements have been increasingly used in display panels as current-type light-emitting devices. Due to a self-luminous property, an electroluminescent display panel does not require a backlight, and has advantages of high contrast, thin thickness, wide viewing angle, fast response speed, flexibility, simple structure, simple manufacturing processes, etc. Therefore, the electroluminescent display panel has gradually become the next generation mainstream display panel. An organic light-emitting diode (OLED) display panel achieves a display function through an OLED array, and is an electroluminescent display panel which is widely used.

SUMMARY

At least one embodiment of the present disclosure provides a brightness adjustment method of a display panel. The display panel comprises a display region, and the brightness adjustment method comprises: determining a target pulse width for a gate signal inputted into the display region according to data write time determined for the display region; and adjusting a pulse width of the gate signal to the target pulse width, to make the display region reach target brightness corresponding to the display region.

For example, in the brightness adjustment method of the display panel provided by an embodiment of the present disclosure, the display panel comprises a plurality of display regions; each display region of the plurality of display regions corresponds to respective data write time; the brightness adjustment method further comprises: determining the respective data write time of each display region, in which determining the respective data write time of each display region comprises: acquiring respective initial brightness corresponding to each display region; and determining the respective data write time corresponding to each display region according to the respective initial brightness and respective target brightness corresponding to each display region.

For example, in the brightness adjustment method of the display panel provided by an embodiment of the present disclosure, the display panel comprises a plurality of display regions and a power line configured to provide a supply voltage for the plurality of display regions; each display region of the plurality of display regions corresponds to respective data write time; the brightness adjustment method further comprises: determining the respective data write time of each display region, in which determining the respective data write time of each display region comprises: acquiring an arrangement order of the plurality of display regions along a voltage drop direction of the power line; and determining the respective data write time corresponding to each display region according to the arrangement order and a quantity of the plurality of display regions.

For example, in the brightness adjustment method of the display panel provided by an embodiment of the present disclosure, a plurality of data write times that are in one-to-one correspondence to the plurality of display regions are sequentially decreased along the voltage drop direction of the power line.

For example, in the brightness adjustment method of the display panel provided by an embodiment of the present disclosure, the display panel further comprises a gate drive circuit; and adjusting the pulse width of the gate signal to the target pulse width comprises: adjusting a pulse width of an input signal of the gate drive circuit according to the data write time determined for the display region; and adjusting the pulse width of the gate signal to the target pulse width according to an adjusted pulse width of the input signal of the gate drive circuit.

For example, in the brightness adjustment method of the display panel provided by an embodiment of the present disclosure, the input signal of the gate drive circuit comprises at least one input sub-signal.

For example, in the brightness adjustment method of the display panel provided by an embodiment of the present disclosure, the display panel comprises a plurality of pixel units; the plurality of pixel units are arranged in a plurality of rows and a plurality of columns; and each display region comprises at least one row of pixel units.

For example, in the brightness adjustment method of the display panel provided by an embodiment of the present disclosure, each pixel unit of the plurality of pixel units comprises a light-emitting element, a drive circuit and a storage capacitor, the drive circuit is configured to control a drive current flowing across the light-emitting element, the storage capacitor is connected to a control terminal of the drive circuit to store a data voltage signal applied to the control terminal; and the data write time is less than charging time for charging the storage capacitor to make the storage capacitor reach a saturated state.

For example, in the brightness adjustment method of the display panel provided by an embodiment of the present disclosure, the display panel is an organic light-emitting diode display panel.

At least one embodiment of the present disclosure further provides a display panel comprising: a display region, a brightness adjustment circuit and a gate drive circuit. The brightness adjustment circuit is configured to: adjust a pulse width of an input signal of the gate drive circuit based on data write time determined for the display region; and the gate drive circuit is configured to: output a gate signal to the display region according to an adjusted pulse width of the input signal, to make the display region reach target brightness corresponding to the display region.

For example, in the display panel provided by an embodiment of the present disclosure, the display panel comprises a plurality of display regions; the brightness adjustment circuit comprises a memory and a processor; each display region of the plurality of display regions corresponds to respective data write time; the memory is configured to acquire and store respective initial brightness corresponding to each display region; and the processor is configured to determine the respective data write time corresponding to each display region according to the respective initial brightness and respective target brightness corresponding to each display region.

For example, in the display panel provided by an embodiment of the present disclosure, the display panel comprises a plurality of display regions and a power line configured to provide a supply voltage for the plurality of display regions; the brightness adjustment circuit comprises a memory and a processor; each display region of the plurality of display regions corresponds to respective data write time; the memory is configured to acquire and store an arrangement order of the plurality of display regions along a voltage drop direction of the power line and a quantity of the plurality of display regions; and the processor is configured to determine the respective data write time corresponding to each display region according to the arrangement order and the quantity of the plurality of display regions.

For example, in the display panel provided by an embodiment of the present disclosure, a plurality of data write times that are in one-to-one correspondence to the plurality of display regions are sequentially decreased along the voltage drop direction of the power line.

For example, in the display panel provided by an embodiment of the present disclosure, the input signal of the gate drive circuit comprises at least one input sub-signal.

For example, in the display panel provided by an embodiment of the present disclosure, an output terminal of the brightness adjustment circuit is connected to an input terminal of the gate drive circuit; and the brightness adjustment circuit is configured to: adjust a pulse width of the at least one input sub-signal according to the data write time determined for the display region; and output the at least one input sub-signal adjusted to the input terminal of the gate drive circuit through the output terminal.

At least one embodiment of the present disclosure further provides a display panel comprising: a display region and a gate drive circuit. The display region comprises a plurality of pixel units; the gate drive circuit is configured to provide a gate signal having a target pulse width to a pixel unit of the plurality of pixel units; the pixel unit is configured to receive the gate signal and be controlled by the gate signal to emit light, to make the display region reach target brightness corresponding to the display region. The target pulse width is acquired by adjusting a pulse width of the gate signal inputted into the display region according to data write time determined for the display region.

At least one embodiment of the present disclosure further provides a driving method for the display panel provided by an embodiment of the present disclosure, comprising a data write phase and a display phase. The pixel unit comprises a light-emitting element, a drive circuit and a storage capacitor, in the data write phase, the target data voltage signal is written into the storage capacitor under control of the gate signal; and in the display phase, the drive circuit drives the light-emitting element to emit light according to the target data voltage signal, to make the display region reach the target brightness corresponding to the display region.

BRIEF DESCRIPTION OF THE DRAWINGS

In order to clearly illustrate the technical solutions of the embodiments of the disclosure, the drawings of the embodiments will be briefly described in the following; it is obvious that the described drawings are only related to some embodiments of the disclosure and thus are not limitative to the disclosure.

DETAILED DESCRIPTION

Figure 1:
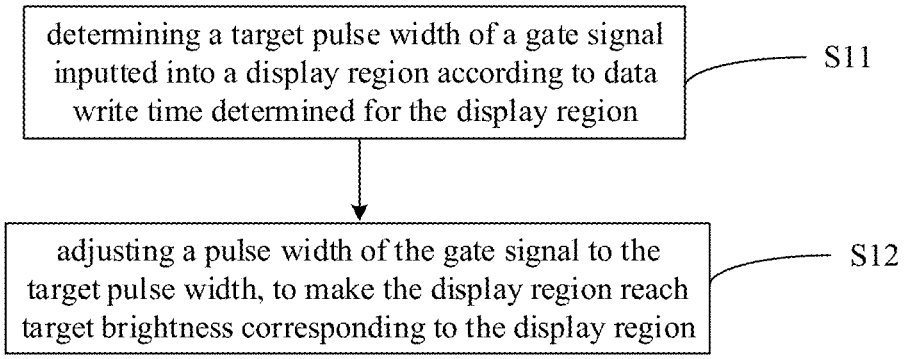
FIG. 1 is a flowchart of a brightness adjustment method of a display panel provided by an embodiment of the present disclosure.

In order to make objects, technical details and advantages of the embodiments of the disclosure apparent, the technical solutions of the embodiments will be described in a clearly and fully understandable way in connection with the drawings related to the embodiments of the disclosure. Apparently, the described embodiments are just a part but not all of the embodiments of the disclosure. Based on the described embodiments herein, those skilled in the art can obtain other embodiment(s), without any inventive work, which should be within the scope of the disclosure.

Unless otherwise defined, all the technical and scientific terms used herein have the same meanings as commonly understood by one of ordinary skill in the art to which the present disclosure belongs. The terms "first," "second," etc., which are used in the present disclosure, are not intended to indicate any sequence, amount or importance, but distinguish various components. Also, the terms such as "a," "an," etc., are not intended to limit the amount, but indicate the existence of at least one. The terms "comprise," "comprising," "include," "including," etc., are intended to specify that the elements or the objects stated before these terms encompass the elements or the objects and equivalents thereof listed after these terms, but do not preclude the other elements or objects. The phrases "connect", "connected", etc., are not intended to define a physical connection or mechanical connection, but may include an electrical connection, directly or indirectly. "On," "under," "right," "left" and the like are only used to indicate relative position relationship, and when the absolute position of the object which is described is changed, the relative position relationship may be changed accordingly.

Depending on different driving modes, organic light emitting diode (OLED) display panel are divided into active OLED (AMOLED) display panels and passive OLED (PMOLED) display panels. A pixel circuit of an AMOLED display panel may include a selection transistor, a driving transistor, and a storage capacitor. The selection transistor is turned on/off through a scanning signal, so as to charge a voltage corresponding to display data to the storage capacitor, thereby controlling the conduction degree of the driving transistor through a data voltage stored by the storage capacitor, controlling a current flowing through an OLED, and adjusting the luminance of the OLED.

An AMOLED display panel can include an internal power supply circuit to provide a constant voltage (e.g., a first supply voltage). Because a power line of the internal power supply circuit has a certain resistance value, IR drop will be generated along an extension direction of the power line (namely a wiring direction of the power line), that is, along a voltage drop direction of the power line, the first supply voltage will change, and first supply voltages are different at different positions on the power line. The difference in the first supply voltage causes a difference in brightness of the display panel, resulting in lower brightness uniformity of the display panel. On the other hand, due to the difference in device performances caused by a manufacturing process of the display panel, the brightness uniformity of the display panel is also affected, thereby affecting the display quality.

At least one embodiment of the present disclosure provides a brightness adjustment method of a display panel, a display panel and a driving method thereof. The brightness adjustment method can solve a problem of uneven brightness caused by factors such as voltage drop of an internal power supply circuit and difference in device performances, improve brightness uniformity of the display panel, and improve the display quality.

Hereinafter, embodiments of the present disclosure will be described in detail with reference to the accompanying drawings. It should be noted that same reference numerals in different drawings will be used to represent same described elements.

At least one embodiment of the present disclosure provides a brightness adjustment method of a display panel. FIG. 1 is a flowchart of a brightness adjustment method of a display panel provided by an embodiment of the present disclosure, referring to FIG. 1, the brightness adjustment method comprises:

S11: determining a target pulse width for a gate signal inputted into a display region according to data write time determined for the display region; and

S12: adjusting a pulse width of the gate signal to the target pulse width, to make the display region reach target brightness corresponding to the display region.

For instance, the display panel may be an organic light-emitting diode (OLED) display panel and includes a display region. The display region includes a plurality of pixel units. Each pixel unit includes a pixel circuit and a light-emitting element (e.g., an OLED). The pixel circuit may include a drive circuit and a storage capacitor. The drive circuit is configured to control a drive current flowing across the light-emitting element. The storage capacitor is connected to a control terminal of the drive circuit to store a data voltage signal applied to the control terminal of the drive circuit. The pixel circuit receives the gate signal and the data voltage signal, and writes the data voltage signal into the storage capacitor within an effective pulse width of the gate signal. The data write time may be the time of writing the data voltage signal into the storage capacitor, and the data write time is determined by the pulse width of the gate signal.

Figure 2A:
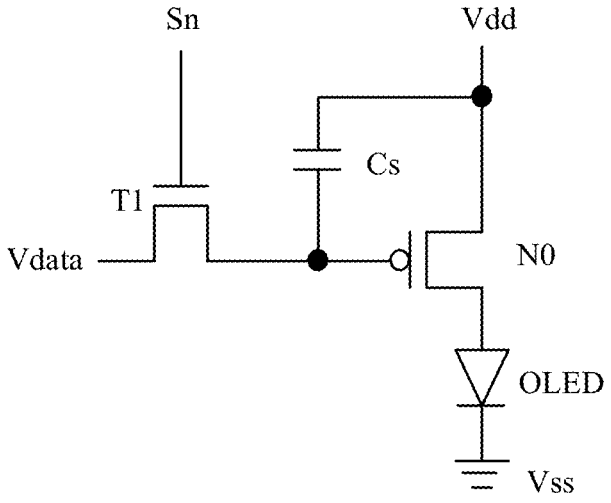
FIG. 2A is a schematic structural view of a 2TIC pixel circuit.

For instance, in some embodiments, a basic pixel circuit may be a 2TIC pixel circuit, namely utilizing two thin-film transistors (TFTs) and one storage capacitor Cs to achieve a basic function of driving the OLED to emit light. FIG. 2A is a schematic structural view of a 2TIC pixel circuit. Referring to FIG. 2A, the pixel circuit includes a first transistor T1, a driving transistor N0 (namely a drive circuit) and a storage capacitor Cs. For instance, a gate electrode of the first transistor T1 is connected to a gate line so as to receive a first gate signal Sn; a source electrode of the first transistor T1 is connected to a data line so as to receive a data voltage signal Vdata; and a drain electrode of the first transistor T1 is connected to a gate electrode of the driving transistor N0. A source electrode of the driving transistor N0 is connected to a first power supply terminal Vdd (e.g., a high voltage terminal), and a drain electrode of the driving transistor N0 is connected to an anode terminal of the OLED. One end of the storage capacitor Cs is connected to the drain electrode of the first transistor T1 and the gate electrode of the driving transistor N0, and the other end of the storage capacitor Cs is connected to the source electrode of the driving transistor N0 and the first power supply terminal Vdd. A cathode terminal of the OLED is connected to a second power supply terminal $V_{SS}$ (e.g., a low voltage terminal), and the second power supply terminal $V_{SS}$ is, for instance, a ground terminal. When the first gate signal Sn is applied through the gate line to turn on the first transistor T1, the data voltage Vdata sent by a data drive circuit through the data line charges the storage capacitor Cs via the first transistor T1, so the data voltage Vdata is stored in the storage capacitor Cs, and the stored data voltage Vdata controls the conduction degree of the driving transistor N0, thereby controlling the magnitude of the current flowing across the driving transistor N0 to drive the OLED to emit light, that is, the current determines the luminous brightness of the OLED.

For instance, the first transistor T1 may be an N-type transistor, and the driving transistor N0 may be a P-type transistor. Of course, the first transistor T1 may also be a P-type transistor, as long as a polarity of the first gate signal Sn that controls the transistor to be turned on or off is correspondingly changed. Similarly, the driving transistor N0 may also be an N-type transistor. No limitation will be given here in the embodiment of the present disclosure.

For instance, the pixel circuit may further include other circuit structures having a compensation function. The compensation function may be implemented by voltage compensation, current compensation or hybrid compensation. The pixel circuit having the compensation function, for instance, may be 4T1C, 4T2C, etc. For instance, the pixel circuit having the compensation function includes a data write circuit, a compensation circuit, a drive circuit and a storage circuit. The drive circuit includes a driving transistor. The storage circuit includes a storage capacitor. In the pixel circuit having the compensation function, the data write circuit and the compensation circuit are cooperated with each other to write the data voltage signal and a threshold voltage of the driving transistor into a control electrode of the driving transistor, and the storage capacitor stores the data voltage signal and the threshold voltage.

Figure 2B:
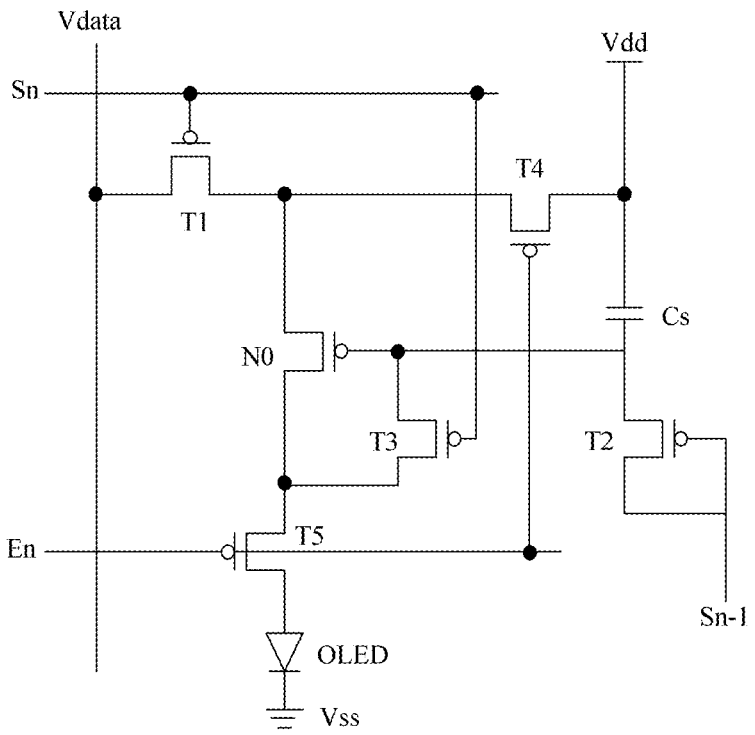
FIG. 2B is a schematic structural view of a pixel circuit having a compensation function.

FIG. 2B is a schematic structural view of a pixel circuit having a compensation function. Referring to FIG. 2B, the pixel circuit includes a driving transistor NO, a first transistor T1, a second transistor T2, a third transistor T3, a fourth transistor T4, a fifth transistor T5 and a storage capacitor Cs. The driving transistor N0 is configured to provide a current for an OLED connected with the driving transistor. In the pixel circuit, the driving transistor N0, the first transistor T1, the second transistor T2, the third transistor T3, the fourth transistor T4 and the fifth transistor T5 are all P-type transistors. Of course, the driving transistor N0, the first transistor T1, the second transistor T2, the third transistor T3, the fourth transistor T4 and the fifth transistor T5 may also be N-type transistors, and the embodiments of the present disclosure are not limited thereto. A source electrode of the third transistor T3 is connected with a gate electrode of the driving transistor N0; a drain electrode of the third transistor T3 is connected with a drain electrode of the driving transistor N0; and a gate electrode of the third transistor T3 receives a first gate signal Sn. When the first gate signal Sn is effective, the first transistor T1, the driving transistor N0 and the third transistor T3 are turned on, so the data voltage signal Vdata charges the storage capacitor Cs through the first transistor T1, the driving transistor N0 and the third transistor T3. By adoption of this circuit structure, a threshold voltage of the driving transistor N0 is recorded, namely the storage capacitor Cs stores a voltage value comprising the data voltage signal Vdata and the threshold voltage of the driving transistor N0. Therefore, in a process in which the driving transistor N0 drives the OLED to emit light, the threshold voltage of the driving transistor is compensated. The current flowing through the OLED may be represented as: $1=\frac{1}{2}K(Vdata-Vdd)^2$, in which K is a predetermined constant. Of course, the structure of the pixel circuit having the compensation function is not limited thereto and may be any suitable structure.

Figure 3:
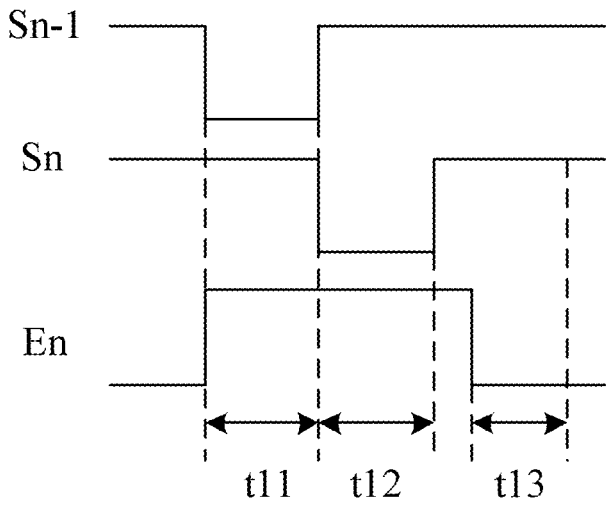
FIG. 3 is a signal timing diagram of a pixel circuit having a compensation function.

FIG. 3 is a signal timing diagram of the pixel circuit shown in FIG. 2B. Referring to FIG. 3, a first gate signal Sn is a scan signal applied to a current scan line, and a second gate signal Sn-1 is a scan signal applied to a previous scan line adjacent to the current scan line. En is a light-emitting control signal. During a t11 period, the second transistor T2 is turned on and the storage capacitor Cs is discharged, so as to initialize the storage capacitor Cs. During a t12 period, the first transistor T1, the driving transistor N0 and the third transistor T3 are turned on, so as to charge the storage capacitor Cs and store the data voltage signal Vdata and the threshold voltage Vth of the driving transistor N0, namely a voltage stored by the storage capacitor Cs is Vdata+Vth. During a t13 period, the fourth transistor T4, the driving transistor N0 and the fifth transistor T5 are turned on, so that the driving transistor NO provides a light-emitting current to the OLED according to the voltage stored in the storage capacitor Cs, and the OLED emits light with brightness corresponding to the light-emitting current.

As known from the analysis of the pixel circuit as shown in FIGS. 2A and 2B, a process of writing the data voltage signal Vdata is essentially a process of charging the storage capacitor Cs. The data write time may be the time of using the data voltage signal Vdata charging the storage capacitor Cs through the first transistor T1. In the process of charging the storage capacitor, the amount of electric charges of the storage capacitor is relevant to the charging time. Of course, the type of the storage capacitor is not limited, according to a manufacturing process, an organic dielectric capacitor, an inorganic dielectric capacitor, an electrolytic capacitor or an air dielectric capacitor may be selected, and other suitable capacitors may also be used.

Figure 4:
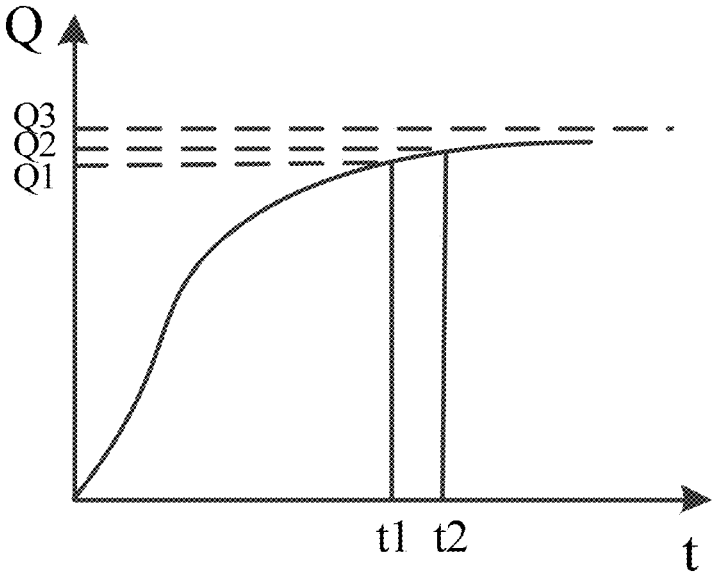
FIG. 4 is a relation curve of a charge amount of a storage capacitor and the charging time.

FIG. 4 is a relation curve of a charge amount of a storage capacitor and charging time. Referring to FIG. 4, the abscissa represents the charging time t; the ordinate represents the charge amount Q; and a charge amount corresponding to the data voltage signal Vdata is a target charge amount Q3. As the charging time t increases, the charge amount Q increases, and the charge amount Q is also closer to the target charge amount Q3; and a capacitor storage voltage (namely a voltage difference between two ends of the capacitor) is also closer to the data voltage signal Vdata. The charge amount Q is in positive correlation to the charging time t. For instance, a first charging time t1 corresponds to a first charge amount Q1; a second charging time t2 corresponds to a second charge amount Q2; and when t2>t1, then Q2>Q1. The capacitor storage voltage is in positive correlation to the charge amount Q. For instance, a capacitor storage voltage corresponding to the first charge amount Q1 is U1; a capacitor storage voltage corresponding to the second charge amount Q2 is U2; and when Q2>Q1, then U2>U1.

In the pixel circuit, the charging time of the storage capacitor will affect the charge amount, so as to affect the voltage difference between two ends of the storage capacitor, thereby affecting the current flowing through the OLED, finally affecting the luminous brightness of the OLED. The charging time of the storage capacitor is equivalent to the data write time, and the data write time is determined by a pulse width of a gate signal inputted into the pixel circuit. When the pulse width of the gate signal is wider, the data write time is longer. Therefore, the charging time of the storage capacitor can be adjusted by adjusting the pulse width of the gate signal, so as to adjust the capacitor storage voltage, thereby controlling the luminous brightness of the OLED of the pixel unit.

Figure 5:
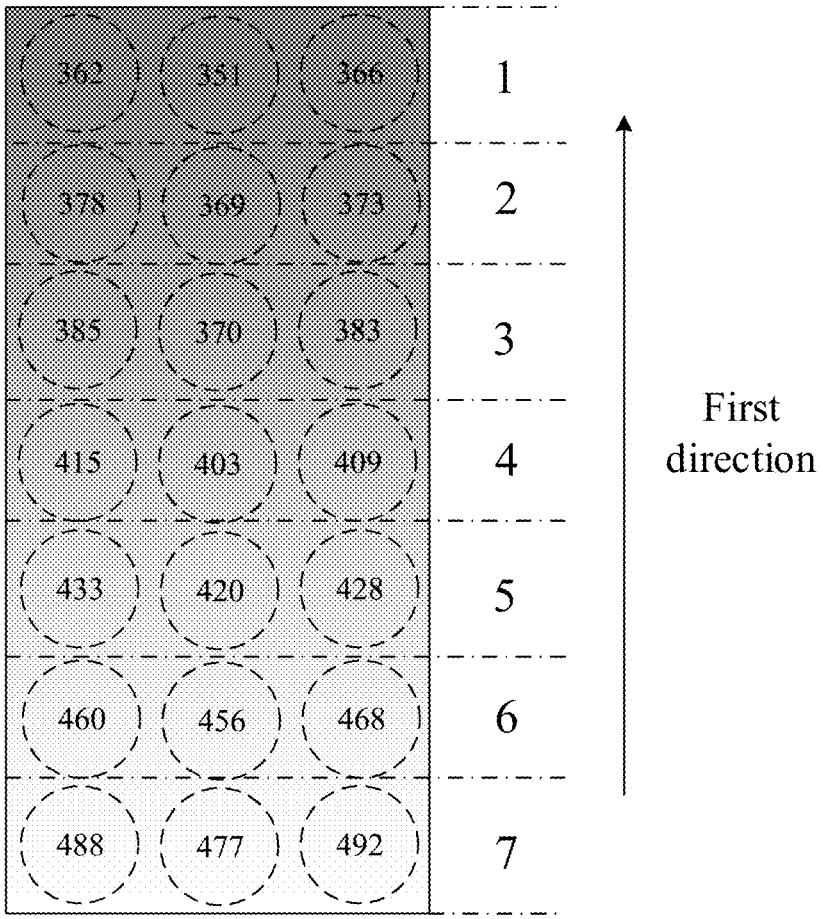
FIG. 5 is a schematic diagram illustrating brightness of an OLED display panel provided by an embodiment of the present disclosure.
Figure 6:
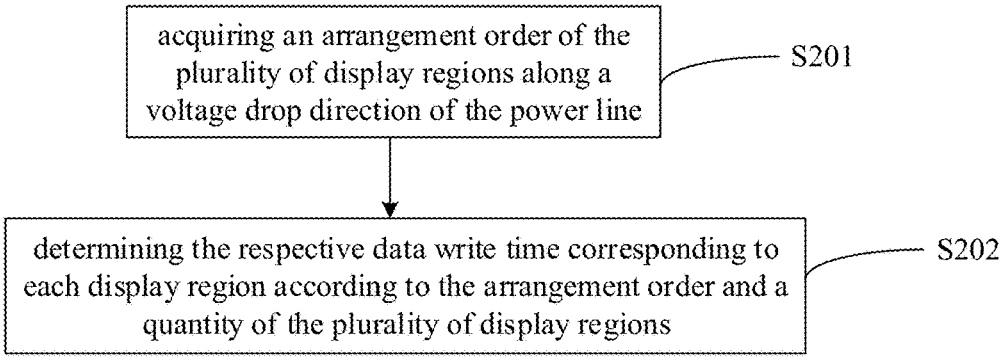
FIG. 6 is a flowchart illustrating a process of determining data write time in a brightness adjustment method provided by an embodiment of the present disclosure.

FIG. 5 is a schematic diagram illustrating brightness of an OLED display panel provided by an embodiment of the present disclosure, and FIG. 6 is a flowchart illustrating a process of determining data write time in a brightness adjustment method provided by an embodiment of the present disclosure. A method for determining data write time according to an embodiment of the present disclosure is described in detail below with reference to FIGS. 5 and 6.

Referring to FIGS. 5 and 6, in one example, the display panel includes a plurality of display regions and a power line configured to provide a supply voltage for the plurality of display regions; each display region of the plurality of display regions corresponds to respective data write time; the plurality of display regions correspond to a plurality of data write times; and the plurality of data write times are in one-to-one correspondence with the plurality of display regions, namely one display region only corresponds to one data write time. If the display panel includes W display regions, the W display regions correspond to W data write times; a first display region corresponds to first data write time; a second display region corresponds to second data write time; . . . ; and so on, and a $W^{th}$ display region corresponds to $W^{th}$ data write time.

For instance, the brightness adjustment method further comprises: determining the respective data write time of each display region. Referring to FIG. 6, operations included in the step of determining the respective data write time of each display region may include:

S201: acquiring an arrangement order of the plurality of display regions along a voltage drop direction of the power line; and S202: determining the respective data write time corresponding to each display region according to the arrangement order and a quantity of the plurality of display regions.

Referring to FIG. 2A, the first power supply terminal Vdd supplies power to each pixel unit through an internal power supply circuit disposed on the display panel. Because the power line in the internal power supply circuit has a certain resistance value, voltage drop occurs along an extension direction of the power line (for instance, a wiring direction of the power line, namely the voltage drop direction of the power line), namely first supply voltages outputted by the first power supply terminal Vdd and received by respective display regions are different from each other, for instance, are sequentially decreased along the voltage drop direction of the power line. The difference in the first supply voltages will cause a difference in the brightness of the respective display regions of the display panel, thereby resulting in poor uniformity of the brightness of the display panel.

Referring to FIG. 5, in one example, along a first direction, a rectangular display panel can be divided into seven display regions (a first display region 1, a second display region 2, a third display region 3, a fourth display region 4, a fifth display region 5, a sixth display region 6 and a seventh display region 7) along a longitudinal direction thereof. The power line in the internal power supply circuit are subjected to wiring along a direction from the seventh display region 7 to the first display region 1 (namely the first direction), that is, the voltage drop direction of the power line is the direction from the seventh display region 7 to the first display region 1, namely the first direction. The data voltage signals Vdata inputted into the respective display regions may be the same. For instance, the number in a circle as shown in FIG. 5 represents the actual luminous brightness of the circle region. As known from the actual luminous brightness, the luminous brightness of the display panel is sequentially reduced from the seventh display region 7 to the first display region 1; the luminous brightness of the seventh display region 7 is maximum: and the luminous brightness of the first display region 1 is minimum.

For instance, a shape of each display region may be a rectangle. But the present disclosure is not limited thereto, each display region may also have other regular or irregular shapes.

For instance, the first supply voltages received by the first display region 1 to the seventh display region 7 may be respectively V11, V12, . . . , V16 and V17. Because there is voltage drop along the extension direction of the power line, the first supply voltages received by the respective display regions are sequentially decreased along the first direction, namely V17>V16> . . . >V12>V11. It can be known from the above formula of the current flowing through the OLED that, in a case where data voltage signals Vdata inputted into the respective display regions are the same, when a value of the first supply voltage is changed, the obtained current is different. For instance, as for a certain data voltage signal Vdata, the smaller the first supply voltage is, the smaller the current flowing through the OLED is. Thus, light-emitting currents flowing through the OLED are sequentially decreased from the seventh display region 7 to the first display region 1, namely the brightness of the display panel is uneven and the brightness is sequentially reduced along the extension direction of the power line. As shown in FIG. 5, the brightness of the respective display regions is sequentially decreases from the seventh display region 7 to the first display region 1.

For instance, a scanning order of the display regions is not limited; scanning may be performed along a direction from the seventh display region 7 to the first display region 1 (namely the first direction) and may also be performed along a direction from the first display region 1 to the seventh display region 7 (namely an opposite direction of the first direction) which is not limited in the embodiments of the present disclosure.

For instance, in the step S201, first, the arrangement order of the plurality of display regions along the voltage drop direction of the power line is acquired, that is, the arrangement order is the seventh display region 7, the sixth display region 6, . . . , up to the first display region 1. Subsequently, a plurality of data write times (for instance, 7 data write times) that are in one-to-one correspondence to the display regions are respectively determined according to the above arrangement order and the number (for instance. 7) of the plurality of display regions. For instance, firstly, data write time corresponding to the seventh display region 7 is determined according to the arrangement order and the number of the plurality of display regions; secondly, data write time corresponding to the sixth display region 6 is determined according to the arrangement order and the number of the plurality of display regions; and so on; and finally, data write time corresponding to the first display region 1 is determined according to the arrangement order and the number of the plurality of display regions. Thus, the plurality of data write times are determined. For instance, the data write time corresponding to the seventh display region 7 is the longest; the data write time corresponding to the first display region 1 is the shortest; and from the seventh display region 7 to the first display region 1, the data write times of the respective display regions are sequentially decreased, namely the data write times of the display regions are sequentially decreased along the voltage drop direction of the power line.

A quantitative relationship among the data write times is not limited and can be determined according to actual demands. For instance, according to the arrangement order, the data write time corresponding to each display region may be 10% or 20% or other applicable ratio smaller than the data write time corresponding to a previous display region adjacent thereto (for instance, the data write time corresponding to the sixth display region 6 is 10% smaller than the data write time corresponding to the seventh display region 7; the data write time corresponding to the fifth display region 5 is 10% smaller than the data write time corresponding to the sixth display region 6; and so on)

For another instance, several display regions can be divided into a group, so the display panel may include a plurality of display region groups. The plurality of display region groups are sequenced. According to the arrangement order, the data write time corresponding to each display region group may be 5% or other suitable ratio smaller than the data write time corresponding to a previous display region group adjacent thereto. For instance, the seventh display region 7 and the sixth display region 6 are divided into a first display region group, and the fifth display region 5 to the first display region 1 are divided into a second display region group, data write time corresponding to the second display region group is 5% smaller than data write time corresponding to the first display region group. By means of grouping, the adjustment process can be simplified in the case that the requirement on the brightness uniformity is not high.

Figure 8:
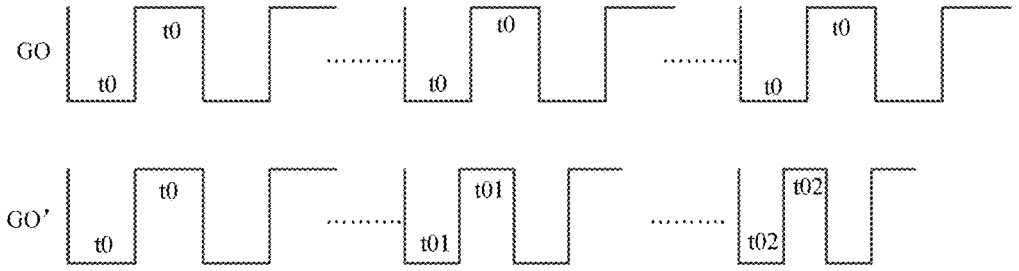
FIG. 8 is a schematic diagram of a gate signal waveform before adjustment and a gate signal waveform after adjustment according to an embodiment of the present disclosure.

The target pulse widths of the gate signals inputted into the respective display regions are determined according to the plurality of data write times determined above, and the pulse widths of the gate signals are adjusted to the target pulse widths. For instance, a target pulse width for a gate signal inputted into the first display region 1 is determined according to data write time corresponding to the first display region 1; a target pulse width for a gate signal inputted into the second display region 2 is determined according to data write time corresponding to the second display region 2; and so on. FIG. 8 is a schematic diagram of a gate signal waveform before adjustment and a gate signal waveform after adjustment. Referring to FIG. 8, a waveform as shown in the figure is a combined waveform of waveforms inputted into the display regions. GO represents the gate signal waveform before adjustment, and the pulse widths of the gate signals of respective display regions are all the same and all are t0. Of course, the embodiments of the present disclosure are not limited thereto, and the pulse widths of the gate signals before adjustment may be same or different. For instance, the pulse widths of the gate signals may be preprocessed according to empirical values before adjustment, so the pulse widths of the gate signals before adjustment can be different. GO' represents the gate signal waveform after adjustment, namely the gate signal waveform having the target pulse widths, and the target pulse widths of the gate signals of the respective display regions are different from each other. For instance, from the seventh display region 7 to the first display region 1, the target pulse widths of the gate signals are sequentially decreased, namely t02<t01<t0.

The pixel circuit charges the storage capacitor according to the target pulse width for the gate signal. Therefore, when the data voltage signals Vdata are the same, from the seventh display region 7 to the first display region 1, the capacitor storage voltages corresponding to the respective display regions are sequentially decreased.

Not only the power line in the internal power supply circuit can affect the brightness uniformity of the display panel, but also the differences in the device performances caused by the manufacturing process of the display panel, such as the performance differences of the TFTs or the storage capacitors in the pixel circuits, or the electromagnetic interference received by the display panel during operation will also affect the brightness uniformity. The factors that affect the brightness uniformity may be any factor, and the embodiments of the present disclosure do not limit the factors affecting the brightness uniformity.

Figure 7:
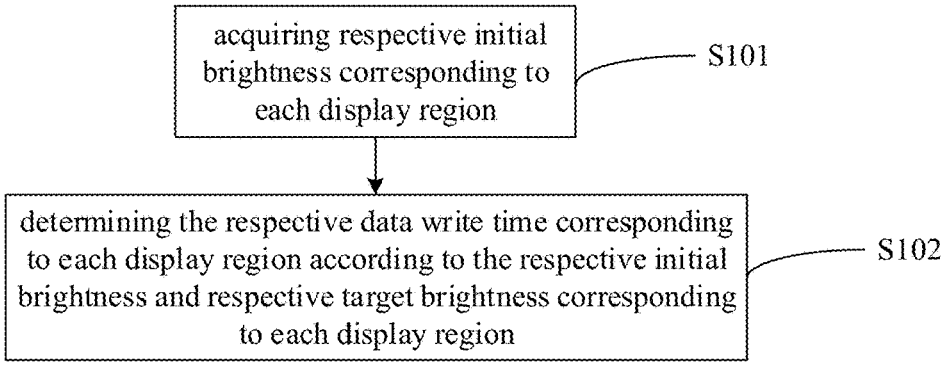
FIG. 7 is a flowchart illustrating a process of determining data write time in another brightness adjustment method provided by an embodiment of the present disclosure.

FIG. 7 is a flowchart illustrating a process of determining data write time in another brightness adjustment method provided by an embodiment of the present disclosure. Another method for determining data write time according to an embodiment of the present disclosure is described in detail below with reference to FIGS. 5 and 7.

Referring to FIGS. 5 and 7, in another example, the display panel includes a plurality of display regions; each display region corresponds to respective data write time; the plurality of display regions correspond to a plurality of data write times; and the plurality of data write times are in one-to-one correspondence with the plurality of display regions, namely one display region only corresponds to one data write time. A description of the plurality of data write times may be referred to the above relevant description in the embodiment as shown in FIG. 6, and details are not described herein again.

For instance, the brightness adjustment method further comprises: determining the respective data write time of each display region. Referring to FIG. 7, operations included in the step of determining the respective data write time of each display region may include:

S101: acquiring respective initial brightness corresponding to each display region; and S102: determining the respective data write time corresponding to each display region according to the respective initial brightness and respective target brightness corresponding to each display region.

For instance, the plurality of display regions are in one-to-one correspondence with a plurality of initial brightness, namely one display region only corresponds to one initial brightness. The plurality of display regions are in one-to-one correspondence with a plurality of target brightness, namely one display region only corresponds to one target brightness. If the display panel includes W display regions, the W display regions correspond to W initial brightness; a first display region corresponds to first initial brightness; a second display region corresponds to second initial brightness; . . . ; and so on, and a $W^{th}$ display region corresponds to $W^{th}$ initial brightness; the W display regions correspond to W target brightness; the first display region corresponds to first target brightness; the second display region corresponds to second target brightness; . . . ; and so on, and the $W^{th}$ display region corresponds to $W^{th}$ target brightness.

In the following description, the display panel includes a first display region and a second display region, and the brightness of the first display region is less than the brightness of the second display region. But the present disclosure is not limited thereto, the brightness of the first display region may also be greater than or equal to the brightness of the second display region.

For instance, in one example, the step S101 includes: inputting a same data voltage signal Vdata to the first display region and the second display region; and detecting actual luminous brightness of the first display region and actual luminous brightness of the second display region, so as to acquire the first initial brightness corresponding to the first display region 1 and the second initial brightness corresponding to the second display region 2.

For instance, due to an influence of the factors such as the voltage drop of the power line in the internal power supply circuit and/or the difference in the device performances caused by the manufacturing process of the display panel, as shown in FIG. 5, when the data voltage signal Vdata inputted into each display region is same, the brightness of the first display region 1 is less than the brightness of the second display region 2, that is, the first initial brightness is less than the second initial brightness.

For instance, the step S102 includes: obtaining the first target brightness corresponding to the first display region 1 and the second target brightness corresponding to the second display region 2 according to the data voltage signal Vdata; and determining the first data write time corresponding to the first display region 1 and the second data write time corresponding to the second display region 2 according to the first initial brightness, the second initial brightness, the first target brightness and the second target brightness.

For instance, the same data voltage signal Vdata is inputted into the first display region and the second display region, and the first target brightness and the second target brightness are the same.

For instance, the first data write time is less than the second data write time. It should be noted that the quantitative relationship between the first data write time and the second data write time is not limited and may be determined according to actual needs.

For instance, the pulse widths of the gate signals are adjusted to the target pulse widths according to the first data write time and the second data write time. The target pulse width for the gate signal corresponds to the data write time, so that a target pulse width for a gate signal corresponding to the first display region 1 is less than a target pulse width for a gate signal corresponding to the second display region 2. The pixel circuit charges the storage capacitor according to the target pulse width for the gate signal. Therefore, in the case of the same data voltage signal Vdata, the capacitor storage voltage corresponding to the first display region 1 is less than the capacitor storage voltage corresponding to the second display region 2.

For instance, referring to FIG. 2B, when the first supply voltage outputted by the first power supply terminal Vdd is fixed at 4.6V, the voltage of the data voltage signal Vdata is 4V, and the threshold voltage Vth of the driving transistor N0 is 2V, due to IR DROP, supposing that in FIG. 5, a first supply voltage V12 at the second display region 2 is 4.5V, a first supply voltage V11 at the first display region 1 is 4.3V. The capacitor storage voltage corresponding to the first display region 1 is Vdata1-Vth, and the capacitor storage voltage corresponding to the second display region 2 is Vdata2-Vth. When the pulse widths of the gate signals are not processed by the brightness adjustment method provided by the embodiment of the present disclosure, Vdata1-Vth is equal to Vdata2-Vth. For instance, in one example, Vdata1-Vth and Vdata2-Vth are both 2V, and in this case, Vgs1=Vdata1-Vth-V11=−2.3V, and Vgs2=−2.5V. Therefore, the brightness of the second display region 2 is greater than the brightness of the first display region 1. But after the pulse widths of the gate signals are processed by the brightness adjustment method provided by the embodiment of the present disclosure, at this point, the capacitor storage voltage corresponding to the first display region 1 is Vdata1'-Vth; the capacitor storage voltage corresponding to the second display region 2 is Vdata2'-Vth; and because the first data write time is less than the second data write time, Vdata1'-Vth is less than Vdata2'-Vth, thus a difference between Vgs1 and Vgs2 will be reduced or become equal. For instance, in one example, Vdata1'-Vth is 1.8V and Vdata2'-Vth is 2V, so Vgs1=Vdata1'-Vth-V11=−2.5V, and Vgs2=Vdata2'-Vth-V12=−2.5 V, namely Vgs1=Vgs2. Thus, the brightness of the first display region 1 and the brightness of the second display region 2 are the same. By analogy, the data write time of each of the remaining display regions on the display panel may also be correspondingly adjusted, so that the brightness of each display region can be same. Therefore, the brightness adjustment method provided by the embodiment of the present disclosure can improve the brightness uniformity of the display panel by gradually adjusting the data write times of different regions.

When not considering the influence of the factors such as the voltage drop of the power line in the internal power supply circuit and/or the difference in the device performances caused by the manufacturing process of the display panel, because the capacitor storage voltage corresponding to the first display region 1 is less than the capacitor storage voltage corresponding to the second display region 2, the brightness of the first display region 1 shall be greater than the brightness of the second display region 2. In actual display, the influence of the factors such as the voltage drop of the power line in the internal power supply circuit and/or the difference in the device performances caused by the manufacturing process of the display panel on the display brightness and the influence of the capacitor storage voltage on the display brightness, for instance, can be balanced out, so that the brightness of the first display region 1 and the brightness of the second display region 2 can be same or close, and then the purpose of improving the brightness uniformity can be achieved.

For instance, a shape and a size of the first display region 1 and a shape and a size of the second display region 2 may be same. The first display region 1 and the second display region 2, for instance, are both in the shape such as rectangle and trapezoid. The first display region 1 may include N rows of pixel units, and the second display region 2 may also include N rows of pixel units. N is a positive integer greater than 0. The embodiment of the present disclosure is not limited thereto. The shape and/or the size of the first display region 1 and the shape and/or the size of the second display region 2 may also be different. For instance, the first display region 1 may include N rows of pixel units; the second display region 2 may include M rows of pixel units; N and M are different; and both N and M are positive integers greater than 0. The embodiment of the present disclosure is not limited thereto.

For instance, the data write times of the display regions (for instance, the first data write time and the second data write time) must be less than the charging time for charging the storage capacitor in the pixel circuit to make the storage capacitor reach a saturated state.

It should be noted that the display regions as shown in FIG. 5 are only illustrative, and according to actual design requirements, the display regions on the display panel can be divided into various required shapes and numbers, which is not limited in the embodiment of the present disclosure.

Figure 9:
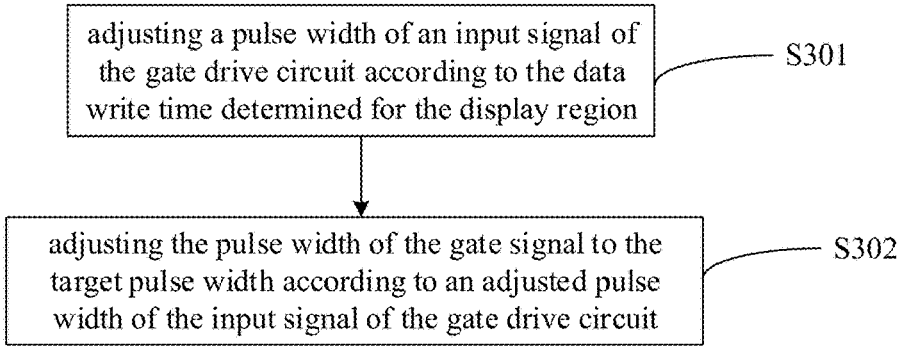
FIG. 9 is a flowchart illustrating a process of adjusting a gate signal in the brightness adjustment method provided by an embodiment of the present disclosure.

FIG. 9 is a flowchart illustrating a process of adjusting a gate signal in the brightness adjustment method provided by an embodiment of the present disclosure. Referring to FIG. 9, in one example, the step of adjusting the pulse width of the gate signal to the target pulse width in the brightness adjustment method may include:

S301: adjusting a pulse width of an input signal of the gate drive circuit according to the data write time determined for the display region; and S302: adjusting the pulse width of the gate signal to the target pulse width according to an adjusted pulse width of the input signal of the gate drive circuit.

For instance, the gate signal inputted into the pixel circuit may be provided by the gate drive circuit, and the gate drive circuit outputs the gate signal to the pixel circuit so as to control the pixel unit to display. The input signal of the gate drive circuit may be provided by a gate driver. For instance, the input signal of the gate drive circuit includes at least one input sub-signal. In the step S301, any input sub-signal may be adjusted, or a plurality of input sub-signals may also be simultaneously adjusted, and the embodiments of the present disclosure are not limited thereto.

Figure 10:
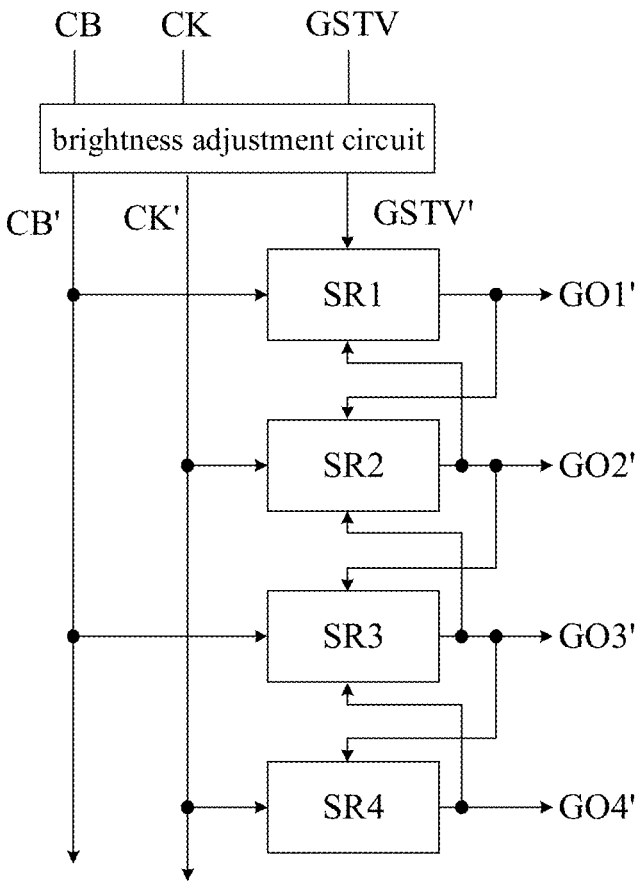
FIG. 10 is a schematic structural view of a gate drive circuit.

FIG. 10 is a schematic structural view of a gate drive circuit. The gate drive circuit comprises a plurality of cascaded sub-circuits. Referring to FIG. 10, the gate drive circuit, for instance, includes a first sub-circuit SR1, a second sub-circuit SR2, a third sub-circuit SR3 and a fourth sub-circuit SR4. Of course, the number of the sub-circuits is not limited to 4 and may be any number. The number of the sub-circuits may be determined according to the number of rows of the pixel units.

The input signal includes a plurality of input sub-signals such as a clock signal, an on signal GSTV, a high level signal VGH (not shown in the figure) and a low level signal VGL (not shown in the figure). The clock signal may include a first clock signal CK and a second clock signal CB as required and is configured to provide clock for the sub-circuits. According to the circuit structure, the number of the clock signals is not limited to two and may be one or more. The high level signal VGH and the low level signal VGL are configured to provide constant voltage signals for the gate drive circuit. According to actual design requirements, each sub-circuit may receive one high level signal VGH and one low level signal VGL, may also receive a plurality of high level signals VGH and a plurality of low level signals VGL, and may also not receive the high level signal VGH and/or the low level signal VGL. No limitation will be given here in the embodiment of the present disclosure. The on signal GSTV is inputted into the first sub-circuit SR1. The on signal GSTV, for instance, may be one or more.

For instance, as shown in FIG. 10, an output terminal of the brightness adjustment circuit is connected with an input terminal of the gate drive circuit. The plurality of input sub-signals (for instance, the on signal GSTV, the first clock signal CK and the second clock signal CB) may be transmitted to the brightness adjustment circuit, and the brightness adjustment circuit may be configured to adjust a pulse width of each of the plurality of input sub-signals according to the data write time determined for the display region, and outputs the plurality of adjusted input sub-signals to the input terminal of the gate drive circuit through the output terminal. For instance, the on signal GSTV, the first clock signal CK and the second clock signal CB are adjusted by the brightness adjustment circuit to obtain an on signal GSTV', a first clock signal CK' and a second clock signal CB'. The on signal GSTV', the first clock signal CK' and the second clock signal CB' may be inputted into the gate drive circuit to control the gate drive circuit to output gate signals (for instance, the gate signals may include a first gate signal GO1', a second gate signal GO2', a third gate signal GO3' and a fourth gate signal GO4').

It should be noted that the plurality of input sub-signals may include a first part of input sub-signals and a second part of input sub-signals, and the first part of input sub-signals may also be directly transmitted to the gate drive circuit, namely the brightness adjustment circuit may only adjust the second part of input sub-signals in the plurality of input sub-signals.

For instance, the first gate signal GO1', the second gate signal GO2', the third gate signal GO3' and the fourth gate signal GO4' are line scanning signals respectively outputted to corresponding pixel units by the first sub-circuit SR1, the second sub-circuit SR2, the third sub-circuit SR3 and the fourth sub-circuit SR4. Moreover, except the first sub-circuit SR1 and the fourth sub-circuit SR4, the gate signal outputted by each sub-circuit is also respectively taken as a reset signal of an adjacent previous sub-circuit and an input signal of an adjacent next sub-circuit. For instance, the second gate signal GO2' may be taken as a reset signal of the first sub-circuit SR1 and an input signal of the third sub-circuit SR3, and the third gate signal GO3' may be taken as a reset signal of the second sub-circuit SR2 and an input signal of the fourth sub-circuit SR4.

Figure 11:
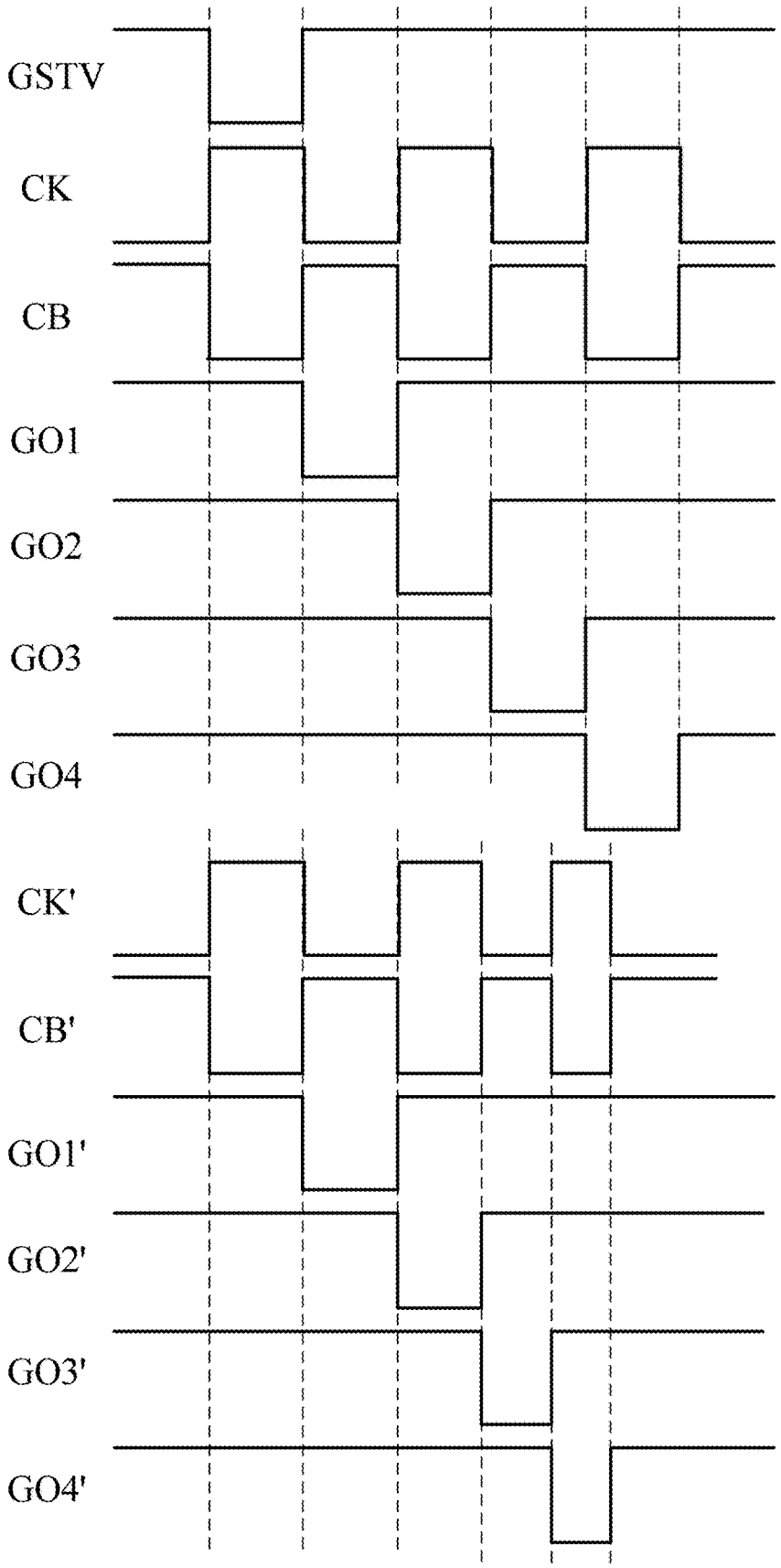
FIG. 11 is a signal timing diagram of a gate drive circuit.

FIG. 11 is a signal timing diagram of a gate drive circuit shown in FIG. 10. Referring to FIGS. 10 and 11, the gate drive circuit may receive the on signal GSTV', the first clock signal CK' and the second clock signal CB', and output a plurality of gate signals (for instance, the first gate signal GO', the second gate signal GO2', the third gate signal GO3' and the fourth gate signal GO4'). After the first sub-circuit SR1 receives the on signal GSTV', when a corresponding first clock signal CK' is at a low level, the first sub-circuit SR1 outputs the first gate signal GO1', and the first gate signal GO' is, for instance, a low-level square wave. The first gate signal GO1' is outputted to a corresponding pixel unit to make the corresponding pixel unit perform a data write operation. The first gate signal GO1' is also taken as an input signal and is transmitted to the second sub-circuit SR2.

Starting from the second sub-circuit SR2, after a subsequent sub-circuit receives the input signal provided by a previous sub-circuit, when a respective corresponding clock signal is at a low level, the subsequent sub-circuit outputs a corresponding gate signal. The gate signal is outputted to a corresponding pixel unit to make the corresponding pixel unit perform a data write operation. In addition, the gate signal is also taken as an input signal and is transmitted to an adjacent next sub-circuit, and is also taken as a reset signal and is transmitted to an adjacent previous sub-circuit. Until an output of the fourth sub-circuit SR4 is finished.

For instance, referring to FIG. 11, the on signal GSTV, the first clock signal CK and the second clock signal CB are input sub-signals before being adjusted by the brightness adjustment circuit, and the on signal GSTV', the first clock signal CK' and the second clock signal CB' are input sub-signals that are adjusted by the brightness adjustment circuit. The first gate signal GO1, the second gate signal GO2, the third gate signal GO3 and the fourth gate signal GO4 are gate signals obtained according to the on signal GSTV, the first clock signal CK and the second clock signal CB. As shown in FIG. 11, a pulse width of the first gate signal GO1, a pulse width of the second gate signal GO2, a pulse width of the third gate signal GO3, and a pulse width of the fourth gate signal GO4 are all the same, and the first gate signal GO1', the second gate signal GO2', the third gate signal GO3' and the fourth gate signal GO4' are gate signals obtained according to the on signal GSTV', the first clock signal CK' and the second clock signal CB'. At least partial gate signals among the first gate signal GO1, the second gate signal GO2', the third gate signal GO3' and the fourth gate signal GO4' have different pulse widths. As shown in FIG. 11, a pulse width of the first gate signal GO1', a pulse width of the second gate signal GO2', a pulse width of the third gate signal GO3', and a pulse width of the fourth gate signal GO4' are all different; the pulse width of the first gate signal GO1' is greater than the pulse width of the second gate signal GO2'; the pulse width of the second gate signal GO2' is greater than the pulse width of the third gate signal GO3'; and the pulse width of the third gate signal GO3' is greater than the pulse width of the fourth gate signal GO4'.

For instance, when each sub-circuit in the gate drive circuit starts output, the output of the previous sub-circuit will be turned off, namely the previous sub-circuit does not output the gate signal. That is to say, when the second sub-circuit SR2 outputs, the output of the first sub-circuit SR1 will be turned off; and when the third sub-circuit SR3 outputs, the output of the second sub-circuit SR2 will be turned off. Thus, the sub-circuits can implement the function of a shift register, and the gate drive circuit can achieve to sequentially output the plurality of gate signals. Of course, the number of the input signals and the output gate signals of the gate drive circuit is not limited to the number described above, may be any number, and may be determined according to actual needs.

For instance, the input sub-signals of the gate drive circuit may be the on signal GSTV, the first clock signal CK, the second clock signal CB, etc. The pulse width of the on signal GSTV, the pulse width of the first clock signal CK or the pulse width of the second clock signal CB all affect the pulse width of the gate signal. Thus, the purpose of adjusting the pulse width of the gate signal can be achieved by adjusting the pulse width of the on signal GSTV, the pulse width of the first clock signal CK or the pulse width of the second clock signal CB. For instance, the input signals described in the step S301 as shown in FIG. 9 may include one or more selected from the on signal GSTV, the first clock signal CK and the second clock signal CB. It should be noted that the input signals may also be other input signals of the gate drive circuit, and the embodiment of the present disclosure does not limit the input signals of the gate drive circuit.

For instance, the pulse widths of the input sub-signals of the gate drive circuit are in positive correlation to the pulse widths of the gate signals outputted by the gate drive circuit, that is, the wider the pulse width of the input sub-signal of the gate drive circuit is, the wider the pulse width of the gate signal is. For instance, in one example, if a target pulse width for a gate signal must be greater than a pulse width of the gate signal before adjustment, a pulse width of at least one input sub-signal can be increased, and the gate drive circuit receives the at least one input sub-signal and outputs the gate signal having the target pulse width, namely the target pulse width for the gate signal after adjustment is greater than the pulse width of the gate signal before adjustment. Moreover, for instance, in another example, if a target pulse width for a gate signal must be smaller than a pulse width of the gate signal before adjustment, a pulse width of at least one input sub-signal can be reduced, and the gate drive circuit receives the at least one input sub-signal and outputs the gate signal having the target pulse width, namely the target pulse width for the gate signal after adjustment is smaller than the pulse width of the gate signal before adjustment.

Figure 12:
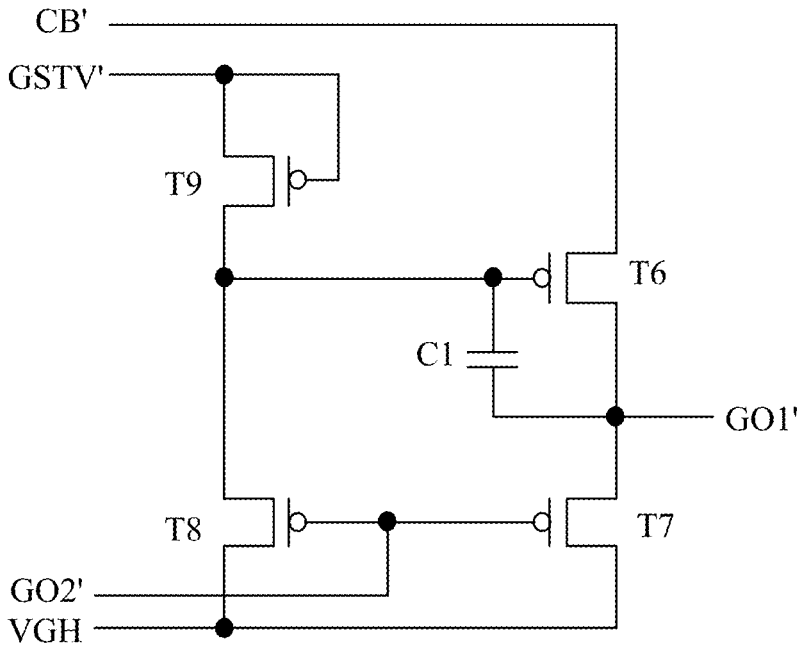
FIG. 12 is a schematic structural view of a sub-circuit of a gate drive circuit.

A working principle of each sub-circuit in the gate drive circuit will be described in detail below by taking the first sub-circuit SR1 as an example. FIG. 12 is a circuit structural schematic view of a first sub-circuit SR1 in the gate drive circuit shown in FIG. 10. It should be noted that the first sub-circuit SR1 generates and outputs the first gate signal GO1' according to the adjusted input sub-signal. Referring to FIG. 12, the first sub-circuit SR1 includes a sixth transistor T6, a seventh transistor T7, an eighth transistor T8, a ninth transistor T9 and a bypass capacitor C1. For instance, a first electrode of the sixth transistor T6 is connected with the second clock signal CB', and a second electrode is connected with a first electrode of the seventh transistor 17 and outputs the first gate signal GO1'. A gate electrode of the sixth transistor T6 is connected with a first electrode of the eighth transistor T8 and a second electrode of the ninth transistor T9. A second electrode of the seventh transistor T7 is connected with a second electrode of the eighth transistor T8 and a high level signal VGH. A gate electrode of the seventh transistor T7 is connected with a gate electrode of the eighth transistor T8, and both the gate electrode of the seventh transistor T7 and the gate electrode of the eighth transistor T8 receive the second gate signal GO2'. A first electrode of the ninth transistor T9 is connected with a gate electrode of the ninth transistor T9 and receives the on signal GSTV'. One end of the bypass capacitor C1 is connected with the gate electrode of the sixth transistor T6, and the other end is connected with the second electrode of the sixth transistor T6.

When the circuit operates, in a case where the on signal GSTV' is at a low level, the ninth transistor T9 and the sixth transistor T6 are turned on, so the first gate signal GO1' is the second clock signal CB', that is, in a case where the second clock signal CB' is at a low level, the first gate signal GO1' is also at a low level. Thus, the pulse width of the second clock signal CB' may be the pulse width of the first gate signal GO'. When the second gate signal GO2' is at a low level, the seventh transistor T7 and the eighth transistor T8 are turned on, so the high level signal VGH is written into the gate electrode and the first electrode of the sixth transistor T6, so as to achieve to reset the sixth transistor T6.

Because the source electrode and the drain electrode of each of the above transistors are symmetrical, the source electrode and the drain electrode of each transistor can be interchanged. The first electrode may be the source electrode or the drain electrode, and accordingly the second electrode may be the drain electrode or the source electrode. For instance, the above transistors are P-type transistors. Of course, the above transistors are not limited to be P-type transistors and may also be N-type transistors, as long as a polarity of a control voltage signal of the gate electrode of the transistor can be changed.

It should be noted that the structure of the first sub-circuit SR1 is not limited to the structure described above, and the first sub-circuit SR1 may be any structure and may also include more or less transistors and/or capacitors. For instance, the first sub-circuit SR1 may also include sub-circuits for implementing the functions such as pull-up node control, pull-down node control and noise reduction. Similarly, the remaining sub-circuits (for instance, the second sub-circuit SR2, the third sub-circuit SR3 and the fourth sub-circuit SR4) in the gate drive circuit may be the structure described above and may also be any suitable structure, and the embodiment of the present disclosure is not limited thereto.

Figure 13:
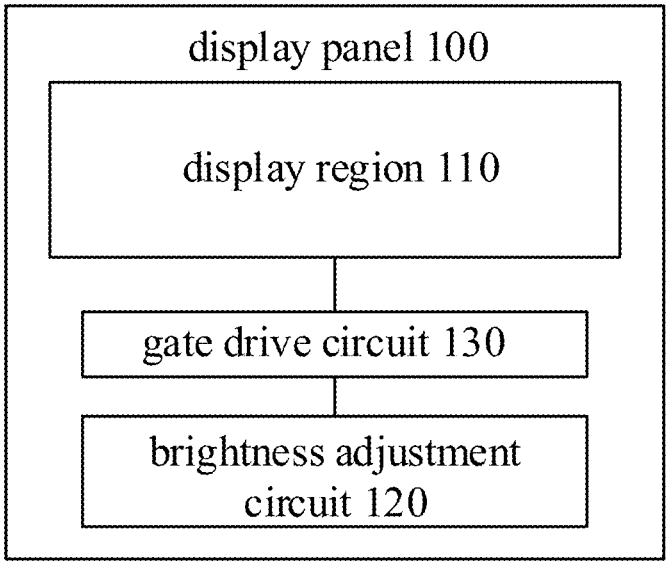
FIG. 13 is a block diagram of a display panel provided by an embodiment of the present disclosure.

At least one embodiment of the present disclosure also provides a display panel. FIG. 13 is a block diagram of a display panel provided by an embodiment of the present disclosure. Referring to FIG. 13, the display panel 100 includes a display region 110, a brightness adjustment circuit 120 and a gate drive circuit 130. The display panel can solve a problem of uneven brightness caused by the factors such as the voltage drop of the internal power supply circuit and the difference in the device performances, improve the brightness uniformity of the display panel, and improve the display quality.

For instance, the brightness adjustment circuit 120 is electrically connected with the gate drive circuit 130 and is configured to adjust a pulse width of an input signal of the gate drive circuit 130 according to the data write time determined for the display region 110. For instance, an output terminal of the brightness adjustment circuit 120 is electrically connected with an input terminal of the gate drive circuit 130, and the brightness adjustment circuit 120 can output the adjusted input signal of the gate drive circuit 130 to the input terminal of the gate drive circuit 130 through the output terminal thereof.

For instance, the brightness adjustment circuit 120 may include a memory and a processor, and the processor is configured to adjust the pulse width of the input signal of the gate drive circuit according to the data write time determined for the display region. For instance, the memory may also store a first computer program instruction, and the processor is configured to execute the first computer program instruction to perform the operation of adjusting the pulse width of the input signal of the gate drive circuit according to the data write time determined for the display region.

For instance, in some examples, when the display panel includes a plurality of display regions and a power line configured to provide a supply voltage for the plurality of display regions; each display region corresponds to respective data write time; the memory is configured to acquire and store an arrangement order of the plurality of display regions along a voltage drop direction of the power line and a quantity of the plurality of display regions; and the processor is configured to determine the respective data write time corresponding to each display region according to the arrangement order and the quantity of the plurality of display regions. For instance, the memory may also store a second computer program instruction, and the processor is configured to execute the second computer program instruction to perform the operation of determining the respective data write time corresponding to each display region according to the arrangement order and the quantity of the plurality of display regions.

For instance, the plurality of data write times that are in one-to-one correspondence to the plurality of display regions are sequentially decreased along the voltage drop direction of the power line.

Moreover, for instance, in some other examples, when the display panel includes a plurality of display regions, each display region corresponds to respective data write time. The memory is configured to acquire and store respective initial brightness corresponding to each display region; and the processor is configured to determine the respective data write time corresponding to each display region according to the respective initial brightness and respective target brightness corresponding to each display region. For instance, the memory may also store a third computer program instruction, and the processor is configured to execute the third computer program instruction to perform the operation of determining the respective data write time corresponding to each display region according to the respective initial brightness and the respective target brightness corresponding to each display region.

It should be noted that the specific operation process of the method for determining the respective data write time may be referred to relevant description of the method as shown in FIG. 6 or 7, and the data write time may also be determined according to other suitable methods, and the embodiment of the present disclosure is not limited thereto.

For instance, the input signal of the gate drive circuit 130 may include one or more selected from the on signal GSTV, the first clock signal CK and the second clock signal CB, and may also be other suitable signals, and the embodiment of the present disclosure is not limited thereto. For instance, the brightness adjustment circuit is configured to: adjust a pulse width of at least one input sub-signal according to the data write time determined for the display region; and output the adjusted at least one input sub-signal to the input terminal of the gate drive circuit through the output terminal. The brightness adjustment circuit may also include an output sub-circuit, and the output sub-circuit includes an output terminal. After the processor performs the operation of adjusting the pulse width of the at least one input sub-signal according to the data write time determined for the display region, the output sub-circuit may receive and output the adjusted at least one input sub-signal to the input terminal of the gate drive circuit.

For instance, the gate drive circuit 130 is configured to adjust the pulse width of the gate signal according to the adjusted pulse width of the input signal, so as to obtain a gate signal having a target pulse width. The gate signal having the target pulse width is outputted to the display region 110, so that the display region 110 can reach target brightness corresponding to the display region 110.

For instance, the display region 110 includes a plurality of pixel units, and the plurality of pixel units are arranged in a plurality of rows and a plurality of columns. A plurality of pixel units in each display region 110 receive the gate signals having the target pulse widths outputted by the gate drive circuit 130, and emit light with corresponding brightness, so that each display region 110 can reach the target brightness corresponding to the display region 110.

In the embodiments of the present disclosure, the display panel may include more or less circuits, and the connection relationship among the circuits is not limited and may be determined according to actual needs. The specific configuration of each circuit is not limited, each circuit may be composed of analog elements according to circuit principles, and may also be composed of digital chips, or may be constructed in other suitable manners.

Moreover, those of ordinary skilled in the art can be aware that the circuits in the various examples described in connection with the embodiments disclosed herein can be implemented in electronic hardware, or a combination of computer software and electronic hardware. Whether these functions are performed in hardware or software depends on the specific application and design constraints of the technical proposal. A skilled person in the art can use different methods to implement the described function for each particular application, but such implementation should not be considered to be beyond the scope of the present disclosure.

Figure 14:
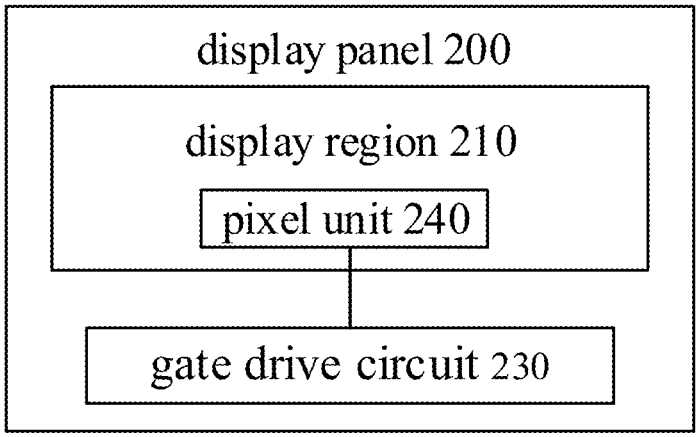
FIG. 14 is a block diagram of another display panel provided by an embodiment of the present disclosure.

At least one embodiment of the present disclosure also provides a display panel. FIG. 14 is a block diagram of another display panel provided by an embodiment of the present disclosure. Referring to FIG. 14, the display panel 200 includes a gate drive circuit 230 and a display region 210. The display panel can solve a problem of uneven brightness, improve the brightness uniformity of the display panel, improve the display quality, does not affect the structure of the conventional display panel, and is easy to implement.

For instance, the display region 210 includes a plurality of pixel units 240. The gate drive circuit 230 is configured to provide a gate signal having a target pulse width to a pixel unit 240. The pixel unit 240 is configured to receive the gate signal having the target pulse width and is controlled by the gate signal having the target pulse width to emit light, so that the display region 210 can reach target brightness corresponding to the display region 210. The target pulse width is acquired by adjusting the pulse width of the gate signal inputted into the display region 210 according to the data write time determined for the display region 210.

For instance, in one example, the display panel 200 is controlled by a display driver chip; the display driver chip includes an adjusting module (for instance, an adjusting circuit); and the adjusting module can adjust the pulse width of the input signal of the gate drive circuit 230, so that the gate drive circuit 230 can output the gate signal having the target pulse width. For instance, in another example, the display panel 200 is electrically connected with a dedicated adjusting device, and the dedicated adjusting device can adjust the pulse width of the input signal of the gate drive circuit 230, so that the gate drive circuit 230 can output the gate signal having the target pulse width.

It should be noted that in the embodiments of the present disclosure, the specific method of adjusting the pulse width of the gate signal is not limited and may be determined according to actual needs.

At least one embodiment of the present disclosure further provides a driving method applied to a display panel provided by an embodiment of the present disclosure. The driving method includes a data write phase and a display phase. The display panel includes at least one display region. Each display region includes a plurality of pixel units, and the pixel unit includes a light-emitting element, a drive circuit and a storage capacitor.

Figure 15:
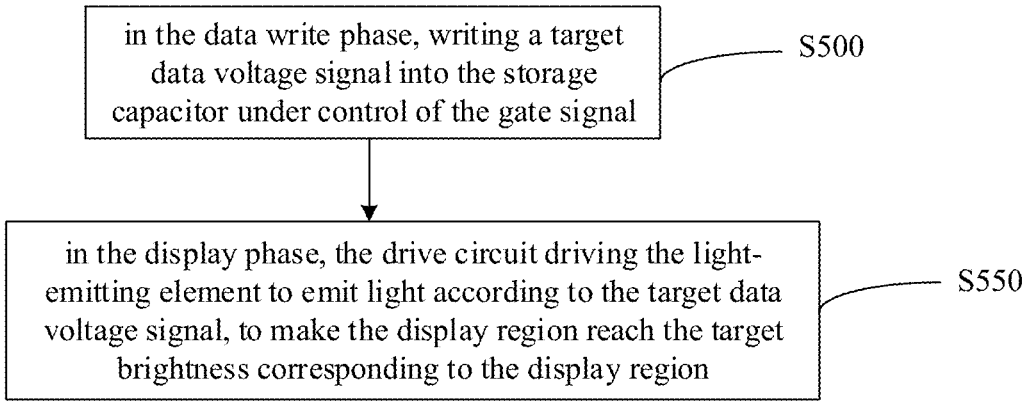
FIG. 15 is a schematic flowchart of a driving method of a display panel provided by an embodiment of the present disclosure.

FIG. 15 is a schematic flowchart of a driving method applied to a display panel provided by any one of the above-mentioned embodiments. Referring to FIG. 15, the driving method of the display panel provided by the embodiment of the present disclosure comprises the following steps:

S500: in the data write phase, writing a target data voltage signal into the storage capacitor under control of the gate signal; and S550: in the display phase, the drive circuit driving the light-emitting element to emit light according to the target data voltage signal, to make the display region reach the target brightness corresponding to the display region.

For instance, in the step S500, the gate signal has a target pulse width.

A data voltage signal written into the storage capacitor is determined by the pulse width of the gate signal, namely the target data voltage signal corresponds to the target pulse width. The target pulse width is acquired by adjusting the pulse width of the gate signal inputted into the display region according to the data write time determined for the display region of the display panel. It should be noted that the specific description of the gate signal may be referred to the relevant description in the above embodiments of the brightness adjustment method of the display panel, and details are not described herein again.

It should be noted that, according to the actual circuit design, the driving method of the display panel may further comprise a restoration phase, a compensation phase, a reset phase and the like, and no specific limitation will be given here in the embodiment of the present disclosure.

The following statements should be noted:

(1) the accompanying drawings of the embodiment(s) of the present disclosure involve only the structure(s) in connection with the embodiment(s) of the present disclosure, and other structure(s) can be referred to common design(s);

(2) in case of no conflict, the embodiments of the present disclosure and the features in the embodiment(s) can be combined with each other to obtain new embodiment(s).

What have been described above are only specific implementations of the present disclosure, the protection scope of the present disclosure is not limited thereto, and the protection scope of the present disclosure should be based on the protection scope of the claims.

The invention claimed is:

1. A brightness adjustment method of a display panel, wherein the display panel comprises a display region; the display panel comprises a plurality of pixel units; the plurality of pixel units are arranged in a plurality of rows and a plurality of columns; and the display region comprises at least one row of pixel units, each pixel unit of the plurality of pixel units comprises a light-emitting element, a drive circuit and a storage capacitor;

the drive circuit is configured to control a drive current flowing across the light-emitting element, the storage capacitor is connected to a control terminal of the drive circuit; and the brightness adjustment method comprises:

determining a target pulse width for a gate signal inputted into the display region according to data write time determined for the display region, wherein the data write time is time for charging storage capacitors in pixel units in the display region and is less than charging time for charging a storage capacitor in each pixel unit in the display region to make the storage capacitor in each pixel unit in the display region reach a saturated state; and adjusting a pulse width of the gate signal to the target pulse width, to make the display region display target brightness corresponding to the display region.

2. The brightness adjustment method of the display panel according to claim 1, wherein the display panel comprises a plurality of display regions; each display region of the plurality of display regions corresponds to respective data write time; and the brightness adjustment method further comprises: determining the respective data write time of each display region, in which determining the respective data write time of each display region comprises:

acquiring respective initial brightness corresponding to each display region; and determining the respective data write time corresponding to each display region according to the respective initial brightness and respective target brightness corresponding to each display region.

3. The brightness adjustment method of the display panel according to claim 1, wherein the display panel comprises a plurality of display regions and a power line configured to provide a supply voltage for the plurality of display regions; each display region of the plurality of display regions corresponds to respective data write time; and the brightness adjustment method further comprises: determining the respective data write time of each display region, in which determining the respective data write time of each display region comprises:

acquiring an arrangement order of the plurality of display regions along a voltage drop direction of the power line; and determining the respective data write time corresponding to each display region according to the arrangement order and a quantity of the plurality of display regions.

4. The brightness adjustment method of the display panel according to claim 3, wherein a plurality of data write times that are in one-to-one correspondence to the plurality of display regions are sequentially decreased along the voltage drop direction of the power line.

5. The brightness adjustment method of the display panel according to claim 1, wherein the display panel further comprises a gate drive circuit; and adjusting the pulse width of the gate signal to the target pulse width comprises:

adjusting a pulse width of an input signal of the gate drive circuit according to the data write time determined for the display region; and adjusting the pulse width of the gate signal to the target pulse width according to an adjusted pulse width of the input signal of the gate drive circuit.

6. The brightness adjustment method of the display panel according to claim 5, wherein the input signal of the gate drive circuit comprises at least one input sub-signal.

7. The brightness adjustment method of the display panel according to claim 1, wherein the storage capacitor is confiqured to store a data voltage signal applied to the control terminal.

8. The brightness adjustment method of the display panel according to claim 1, wherein the display panel is an organic light-emitting diode display panel.

9. The brightness adjustment method of the display panel according to claim 2, wherein the display panel further comprises a gate drive circuit; and adjusting the pulse width of the gate signal to the target pulse width comprises:

adjusting a pulse width of an input signal of the gate drive circuit according to the data write time determined for the display region; and adjusting the pulse width of the gate signal to the target pulse width according to an adjusted pulse width of the input signal of the gate drive circuit.

10. The brightness adjustment method of the display panel according to claim 3, wherein the display panel further comprises a gate drive circuit; and adjusting the pulse width of the gate signal to the target pulse width comprises:

adjusting a pulse width of an input signal of the gate drive circuit according to the data write time determined for the display region; and adjusting the pulse width of the gate signal to the target pulse width according to an adjusted pulse width of the input signal of the gate drive circuit.

11. A display panel, comprising: a display region, a brightness adjustment circuit and a gate drive circuit, wherein the display panel comprises aplurality of pixel units; the plurality of pixel units are arranged in a plurality of rows and a plurality of columns; and the display region comprises at least one row of pixel units, each pixel unit of the plurality of pixel units comprises a light-emitting element, a drive circuit and a storage capacitor;

the drive circuit is configured to control a drive current flowing across, the light-emitting element, the storage capacitor is connected to a control terminal of the drive circuit;

the brightness adjustment circuit is configured to: adjust a pulse width of an input signal of the gate drive circuit based on data write time determined for the display region, wherein the data write time is time for charging storage capacitors in pixel units in the display region and is less than charging time for charging a storage capacitor in each pixel unit in the display region to make the storage capacitor in each pixel unit in the display region reach a saturated state; and the gate drive circuit is configured to: output a gate signal to the display region according to an adjusted pulse width of the input signal, to make the display region display target brightness corresponding to the display region.

12. The display panel according to claim 11, wherein the display panel comprises a plurality of display regions; the brightness adjustment circuit comprises a memory and a processor; each display region of the plurality of display regions corresponds to respective data write time;

the memory is configured to acquire and store respective initial brightness corresponding to each display region; and the processor is configured to determine the respective data write time corresponding to each display region according to the respective initial brightness and respective target brightness corresponding to each display region.

13. The display panel according to claim 11, wherein the display panel comprises a plurality of display regions and a power line configured to provide a supply voltage for the plurality of display regions; the brightness adjustment circuit comprises a memory and a processor; each display region of the plurality of display regions corresponds to respective data write time;

the memory is configured to acquire and store an arrangement order of the plurality of display regions along a voltage drop direction of the power line and a quantity of the plurality of display regions; and the processor is configured to determine the respective data write time corresponding to each display region according to the arrangement order and the quantity of the plurality of display regions.

14. The display panel according to claim 13, wherein a plurality of data write times that are in one-to-one correspondence to the plurality of display regions are sequentially decreased along the voltage drop direction of the power line.

15. The display panel according to claim 11, wherein the input signal of the gate drive circuit comprises at least one input sub-signal.

16. The display panel according to claim 15, wherein an output terminal of the brightness adjustment circuit is connected to an input terminal of the gate drive circuit; and the brightness adjustment circuit is configured to: adjust a pulse width of the at least one input sub-signal according to the data write time determined for the display region; and output the at least one input sub-signal adjusted to the input terminal of the gate drive circuit through the output terminal.

17. The display panel according to claim 13, wherein the input signal of the gate drive circuit comprises at least one input sub-signal, an output terminal of the brightness adjustment circuit is connected to an input terminal of the gate drive circuit, the brightness adjustment circuit is configured to: adjust a pulse width of the at least one input sub-signal according to the data write time determined for the display region; and output the at least one input sub-signal adjusted to the input terminal of the gate drive circuit through the output terminal.

18. A display panel, comprising: a display region and a gate drive circuit, wherein the display region comprises a plurality of pixel units; the plurality of pixel units are arranged in a plurality of rows and a plurality of columns; and the display region comprises at least one row of pixel units, each pixel unit of the plurality of pixel units comprises a light-emitting element, a drive circuit and a storage capacitor;

the drive circuit is configured to control a drive current flowing across the light-emitting element, the storage capacitor is connected to a control terminal of the drive circuit;

the gate drive circuit is configured to provide gate signals to the plurality of pixel units, the gate signals are in one-to-one correspondence to target pulse widths;

the plurality of pixel units are configured to receive the gate signals and be controlled by the gate signals to emit light, to make the display region display target brightness corresponding to the display region; and the target pulse widths are acquired by adjusting pulse widths of the gate signals inputted into the display region according to data write time determined for the display region, and the data write time is time for charging storage capacitors in pixel units in the display region and is less than charging time for charging a storage capacitor in each pixel unit in the display region to make the storage capacitor in each pixel unit in the display region reach a saturated state.

19. A driving method of the display panel according to claim 18, comprising: a data write phase and a display phase, wherein each of the plurality of pixel units comprises a light-emitting element, a drive circuit and a storage capacitor;

the driving method comprises:

in the data write phase, writing a target data voltage signal into the storage capacitor under control of the gate signal; and in the display phase, the drive circuit driving the light-emitting element to emit light according to the target data voltage signal, to make the display region display the target brightness corresponding to the display region.

* * * * *